United States Patent [19]

Jeromin et al.

[11] Patent Number: 4,662,313

[45] Date of Patent: May 5, 1987

[54] IMAGE DENSITY CONTROLLER

[75] Inventors: Lothar S. Jeromin, Sierra Madre; Richard E. Noon, Hacienda Hts., both of Calif.

[73] Assignee: Xerox Corporation, Stamford, Conn.

[21] Appl. No.: 790,686

[22] Filed: Oct. 23, 1985

[51] Int. Cl.[4] ..... B05C 11/00; G03G 15/10

[52] U.S. Cl. ..... 118/691; 118/660; 222/57; 222/DIG. 1; 355/10

[58] Field of Search ..... 118/660, 691; 222/57, 222/DIG. 1; 355/10

[56] References Cited

U.S. PATENT DOCUMENTS

| | | | |
|---|---|---|---|
| Re. 27,480 | 9/1972 | Kamola | 118/691 |
| 3,376,854 | 4/1968 | Kamola | 118/691 |
| 3,399,652 | 9/1968 | Gawron | 118/691 |
| 3,635,373 | 1/1972 | Kuhl et al. | 118/691 X |
| 3,727,065 | 4/1973 | Maksymiak | 250/218 |
| 3,757,999 | 9/1973 | Maksymiak | 222/57 |

*Primary Examiner*—Evan K. Lawrence

*Attorney, Agent, or Firm*—Robert E. Cunha

[57] ABSTRACT

An apparatus that determines the density of the liquid developer in a xerographic system by depositing charged toner on a NESA glass segment, and optically measuring the density of the toner. A cleaning station is also provided. If the toner density is too low, more toner is added, and the test is repeated.

3 Claims, 7 Drawing Figures

FIG. 3A
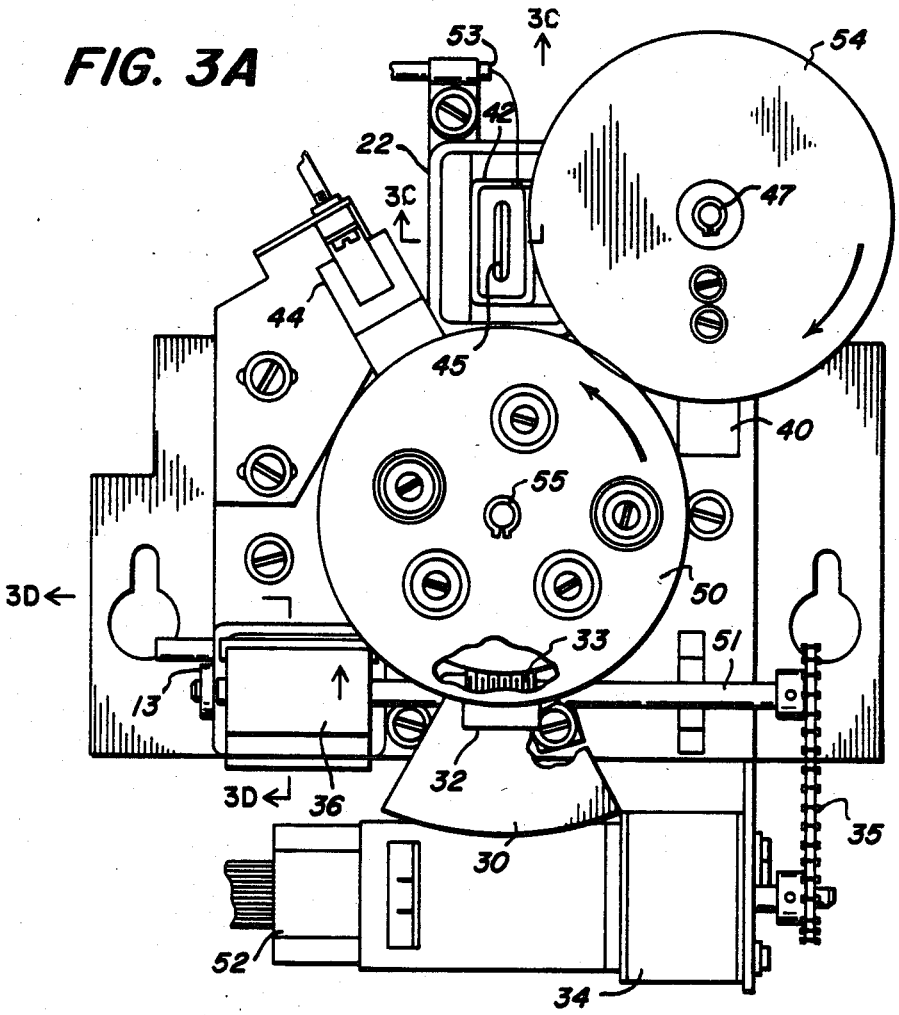
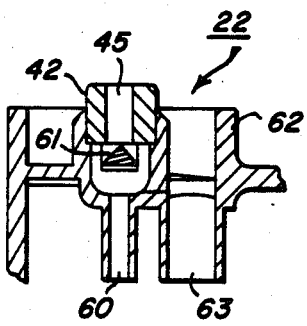
FIG. 3C
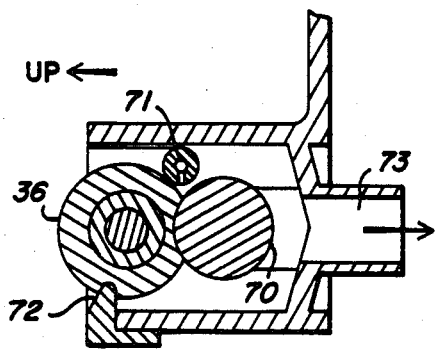
FIG. 3D

IMAGE DENSITY CONTROLLER

BACKGROUND OF THE INVENTION

This invention is an automatic tone density controller for maintaining the correct toner density in a xerographic imaging system and specifically is a miniature development station which coats a piece of NESA glass with liquid toner, and tests the resultant optical density.

In a typical xerographic system, dry toner and carrier particles are applied to an exposed plate. Because of differing electrical charges between the toner and plate, toner is stripped from the carrier particles and deposited on the plate, and, periodically, toner must be added to the carrier. Several automatic toner density controllers have been invented to do this.

The most common controller uses a charged plate of NESA glass to attract toner, and optically measures the density of toner attracted to the plate. This method suffers from inaccuracies due to the build-up of toner and other contaminants on the glass and other parts of the sensor assembly.

In copiers using liquid toner, it is common for the image density to be controlled indirectly by monitoring the turbidity or optical density of the liquid developer. This is accomplished by sending the developer through a glass tube and by measuring the transmission density electro-optically. If the transmission density has fallen below a reference density, toner concentrate will be added automatically until the sensed reading equals the reference value.

This relatively simple liquid toner controller has two basic problems. First, the glass tube tends to collect toner on its inside walls. Since the sensor is looking for a constant level of light transmitted through the walls and developer fluid flowing between them, any toner build-up on the walls results in an unwanted decrease in toner density. Second, the amount of toner deposited on a photoreceptor, and thus the image density, depends mainly on the particle concentration, charge-to-mass ratio (Q/M), mobility of the toner particles in the carrier fluid and the conductance of the carrier fluid. For example, for the same toner concentration, lower Q/M toner produces lighter images than higher Q/M toner, and toners of higher mobility or conductance generate darker images than toners that have a measurably lower mobility or conductance. To overcome a drop in Q/M, toner concentrate could be added to maintain an average image density if the change in Q/M could be detected. Other factors that affect density are the fountain flow rate, fountain gap, fountain field voltage and plate speed and time.

Since most liquid developers, especially highly sensitive ones as are being used in the preferred embodiment, exhibit temporal changes of Q/M, mobility and conductance, a toner density controller compensating for all of the above-mentioned property changes needed to be invented. The need is severe in a mammography system since mammography radiologists look predominately for changes over long periods of time in breast morphology, thus highlighting the need for consistent image density as patients return for repeat examinations.

In the context of an automatic system for the development of mammography x-ray images exposed on xerographic plates, there is a more severe constraint. Because of the hazard of x-rays, the patient must be exposed to a minimum amount of radiation. Therefore, there must be a high level of confidence in the system before the plate is exposed the first time, so that there will be no repeat exposures.

SUMMARY OF THE INVENTION

The preferred embodiment of this invention is used in an automatic system for developing latent mammography images which are formed on xeroradiographic plates through x-ray radiation. In use, each plate is contained in a light proof cassette to prevent discharge of the charge on the plate except by the x-ray radiation. To develop the image, the entire cassette is inserted into a light-tight processor, wherein the plate is removed from its container and developed.

Prior to this development process, the toner will have been tested, and if the toner density was too low, toner would have been added before development would be allowed to take place.

The toner density controller test apparatus comprises a NESA glass segment which is driven in a circular path, taking the segment over a miniature liquid toner fountain for depositing toner onto the glass, an optical sensor for reading the deposited toner density, and a foam roll cleaner for cleaning the NESA glass for the next test cycle. There is an additional fountain electrode wiper which cleans the fountain between development cycles. The result is a toner density test procedure which yields accurate readings over long periods of time.

BRIEF DESCRIPTION OF THE DRAWINGS

FIGS. 3A, 3B, 3C and 3D are detailed views of a second embodiment of a toner controller system.

DESCRIPTION OF THE PREFERRED EMBODIMENT

Figure 1:
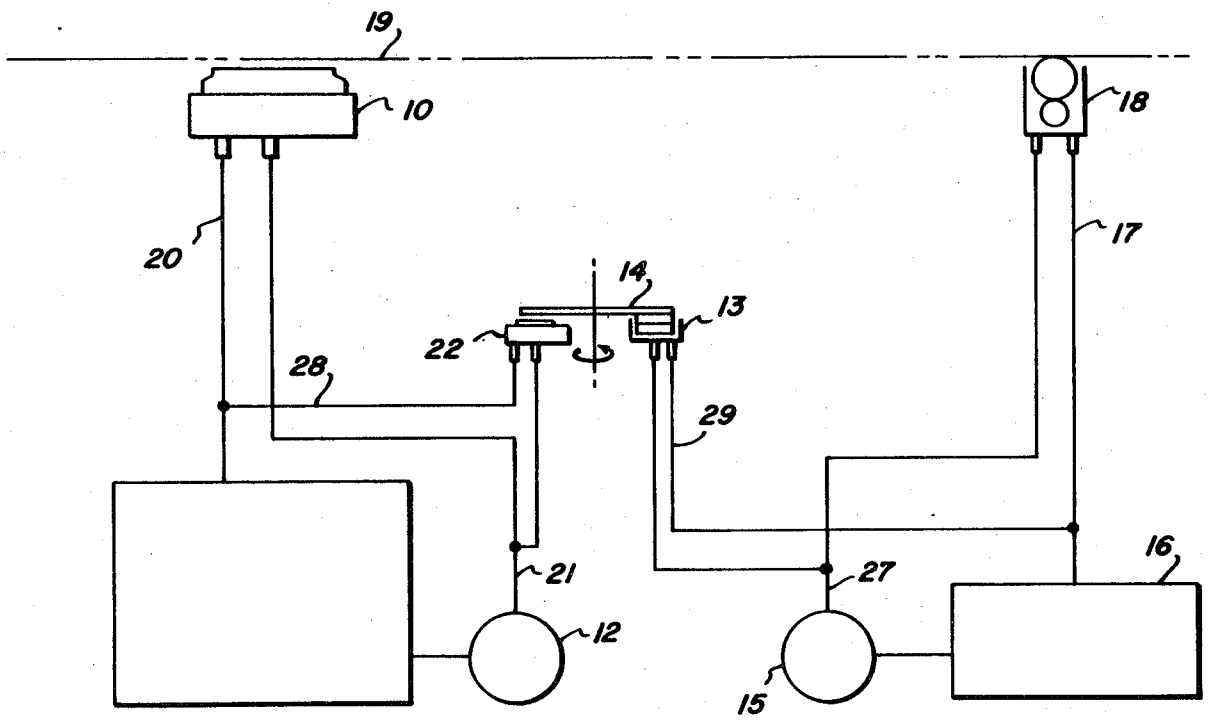
FIG. 1 is a simplified diagram of the test system.

Referring to FIG. 1, the xeroradiographic plate containing the x-ray image travels in a linear path from left to right, shown in this figure as a line 19. At one point, it passes over the imaging fountain 10, which deposits onto the plate an amount of toner to create an image. Further to the right, and after the development station which is not shown in this figure, the plate passes over the plate cleaner 18 which removes all of the toner and any other contaminants that may have been trapped on the plate surface.

The toner is stored in the fountain reservoir 11, which in this embodiment has a capacity of two gallons. From the reservoir 11 it is pumped by pump 12 through the pressure outlet 21 to the imaging fountain 10. From there, the toner is drained through drain tube 20 back into the reservoir 11. Similarly, the cleaning solution, a clear isopar, is stored in the cleaner reservoir 16, and is supplied by pump 15 through the pressure outlet 27 to feed cleaner to the plate cleaner 18. The return is through drain 17 back to the reservoir 16.

The NESA glass segment 30 (FIG. 2A) in the toner density controller 14 is developed in a similar process. The toner density controller 14 comprises the glass segment 30 which travels in a circular path in a plane parallel to the page, and rotates as shown by the arrow. This test plate passes over its development controller function 22, and its cleaning station 13. The development fountain 22, not shown, has a single slot, and a constant toner flow rate. An optical source/sensor for measuring toner density is located between these two stations, but is also not shown in this figure. The fountain 22 is supplied with toner from the pump 12, and there is a drain 28 which leads back to the reservoir 11. Similarly, the cleaning station 13 is supplied with cleaner from pump 15 through pressure outlet 27, and is drained through drain tube 29 back to the reservoir 16.

Figure 2A:
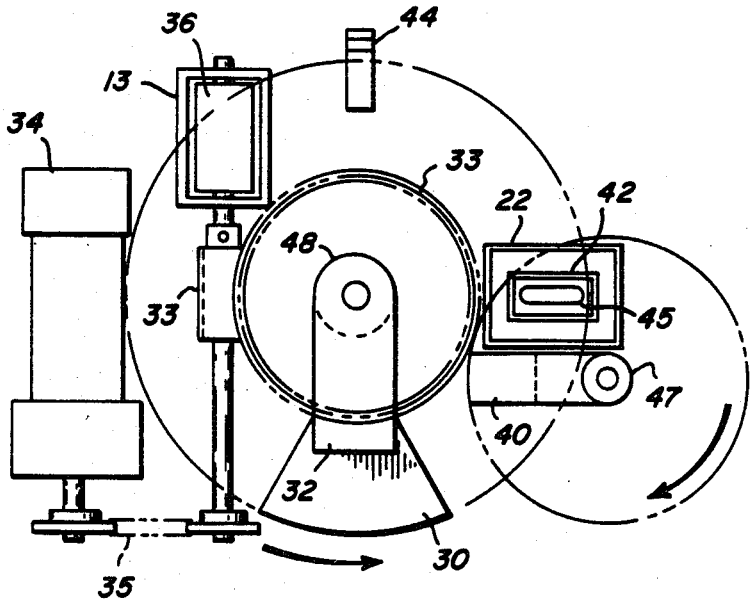
FIGS. 2A and 2B are simplified views of a first embodiment of a toner controller system.

FIG. 2A shows the toner controller 14 in more detail. The photoreceptor plate used to produce the image in the actual mammography system is simulated in the toner controller with a glass segment 30 which has a transparent conductive coating on the side facing the fountain 22. It is known in the industry as NESA glass. The segment 30 is attached to an arm 32 which, in turn, is connected to a worm gear assembly 33. The worm gear assembly is driven by a servo motor 34 through chain drive 35 so as to maintain constant glass segment 30 velocity, that is, to maintain constant development time. The servo motor 34 also drives the foam roller 36 which is part of the cleaning station 13, and a fountain electrode wiper 40. The glass segment 30 is held at ground potential be means of a sliding contact, not shown. The electrode 42 of the toner controller fountain 22 is biased at from 400 to +1,000 volts, creating a development field as the segment 30 is passing over the fountain 22.

As the segment 30 is passing over the fountain 22 comprising a single slot 45, at a 1 mm distance, the development field deposits toner particles on the conductive side. The segment 30 moves on to a sensor 44 comprising an LED and a phototransistor which takes 16 transmission density readings as the segment 30 passes by. The readings are averaged and the average is compared to a reference value. If the measured value is less than the reference value, toner concentrate is added to raise the developer fluid density. If the measured value is greater than the reference value, the development time of the system photoreceptor may be shortened by increasing the photoreceptor velocity as it traverses across the imaging fountain. However, in the embodiments described herein, no corrective ation is taken. There is no controlling action when the measured value equals the reference value.

During measuring, averaging and comparing, the segment 30 rotates past the cleaning station 13, which removes the deposited toner. Also, the fountain electrode 42 is biased, and tends to collect toner which narrows the gap between fountain electrode 42 and the glass segment 30. Therefore, a wiper 40 is also provided which cleans the development electrode 42 surface so that flow rate and development gap between the glass segment and the electrode are maintained constant. The wiper 40 is connected to a shaft 47 which is chain or belt driven from shaft 48. See FIG. 2A. In order for the foam rotation to be clockwise as shown, the belt, not shown, is attached in a "figure 8" arrangement. Once the segment 30 has been cleaned, the controller is ready for the next deposition and sense cycle. This process sequence is continually repeated while the system is actively processing images or while in standby.

Figure 2B:
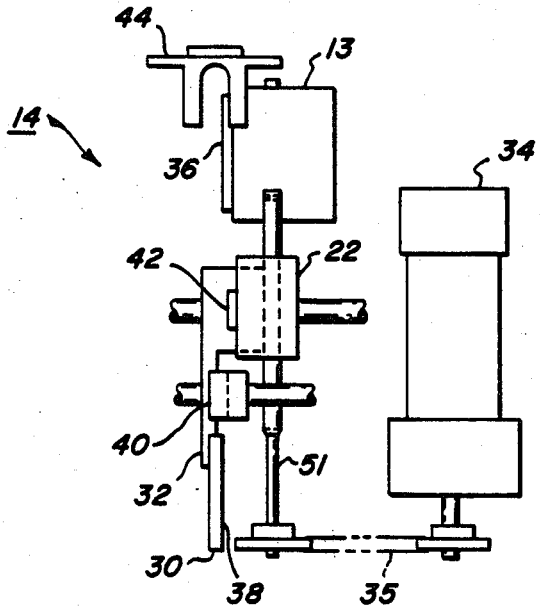

FIG. 2B is a side view of the toner controller 14. The servo motor 34 drives a worm gear assembly through a chain drive 35 and shaft 51. The segment arm 32, and the glass segment 30 which is attached to it, are driven in a circular path in a plane perpendicular to the page. The segment 30 passes over the fountain 22, through the sensor 44 and over the cleaning station 13, in that order. Before the segment 30 passes the fountain 22, the fountain electrode wiper 40 is driven over the fountain electrode 42 to clean it for the next cycle. The conductive coating 38 is located on the bottom of the glass segment 30, as shown.

An LED, not shown, is mounted on one arm of the sensor assembly 44 and transmits light through the glass segment 30 to a phototransistor and pull-up resistor, not shown, in the other arm. A comparator tests the voltage across the phototransistor and develops an output signal.

FIG. 3A is a top view of a second embodiment of the toner density controller 14.

The NESA glass segment 30 which simulates the large plate photoreceptor is attached to worm gear 33 by means of an arm 32. The worm gear 33 is driven by a servo motor 34 through a chain drive 35, and shaft 51. The particular chain used in this embodiment is manufactured from braided wire formed into chain links and encapsulated in plastic. It provides a smooth drive and does not require any lubrication. However, any equivalent belt or chain drive between the motor 34 and shaft 51 would be sufficient.

The motor 34, worm gear 33 and glass segment 30 must rotate at a constant speed. For this purpose, a tachometer 52 is provided. The motor 34 speed is monitored and corrected if necessary by a central processor which controls the entire system.

The toner density is tested once after each three system development cycles by rotating the glass segment 30 through a complete rotation, at the end of which rotation, the segment 30 stops in the "home" position as shown in FIG. 3A. This home position is sensed by a magnet 58, which is attached to the bottom of the worm gear 33 and a hall effect switch, 57, attached to the housing 59 which senses the magnetic field. An optical sensor or microswitch was not used for this application because the build-up of dust and toner would obstruct the light beam or mechanism.

If the density of the toner is sensed to be low, a predetermined amount of toner is injected into the toner reservoir, about three to five seconds is allowed for the added toner to mix, and the density test is repeated. In the case where the toner density is tested to be very low, several times the above-mentioned predetermined amount may be injected at one time to speed the process. In all cases where the toner test is in progress, or during the five second mixing period, the system is disabled so that the operator cannot make low density images. If the density is tested to be too high, no corrective action is taken. The reason is that the test of density by the density controller is much more precise than the observation of the operator, and that any slight excess of toner density produced by the system will not be detectable by inspection of the resultant image.

The test process involves rotating the glass segment 30*b* counterclockwise over the development fountain 22, the density sensor 44 and the cleaning station 13. At the development fountain 22, a voltage of between 400 and 1,000 volts is applied to the electrode 42 through wire 53. Before toner is plated onto the glass segment 30, the fountain is cleaned by a foam wiper 40 which is driven by a gear 54 which in turn is driven by gear 50.

The cleaning station foam roller 36 is driven by shaft 51 so that its surface direction at the point of contact with the glass segment 30 is opposite the direction of the glass segment, as shown by the directional arrows.

Figure 3B:
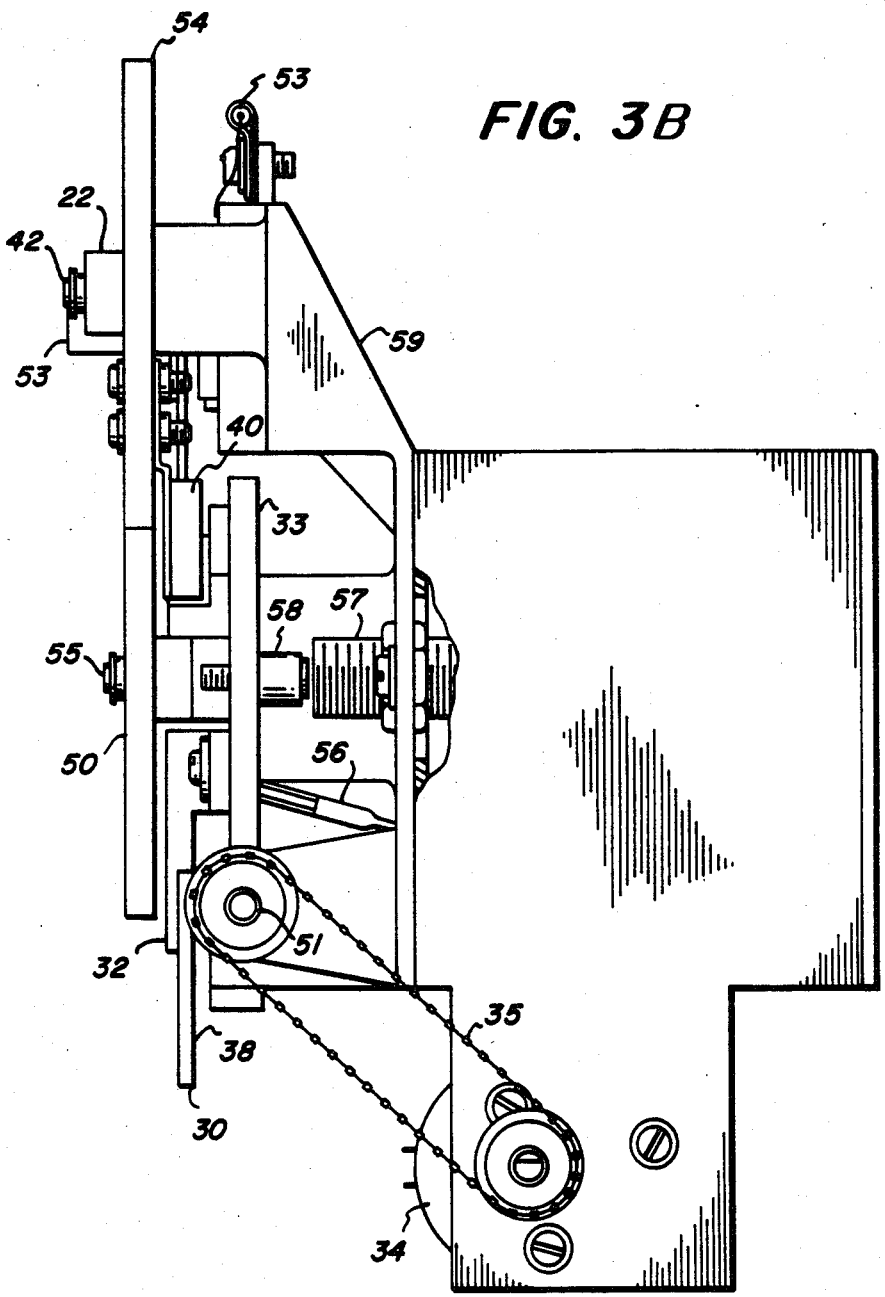

The side view of the mechanism of FIG. 3A is shown in FIG. 3B. The motor 34 is coupled by chain drive 35 to the shaft 51 which drives worm gears 33 and 54 through gear 50. The gear 50 and worm gear 33 rotates about bearing shaft 55.

The glass plate 30 must be maintained at zero volts. This is done by electrically coupling it through arm 32 and worm gear 33 to a grounding brush 56. To guarantee electrical contact, the glass is attached to the arm with conductive glue.

FIG. 3C is section A—A taken from FIG. 3A, and shows the internal construction of the fountain 22. The liquid developer enters through fluid input 60, is directed horizontally by baffle 61, and then flows up through the slot 45 to form a standing wave of developer which contacts the glass plate 30. The aluminum electrode 42 is biased at between 400 and 1000 volts, and is insulated from the supporting members by an injection molded plastic housing 62. The toner then returns to the reservoir through return line 63.

FIG. 3D is section B—B taken from FIG. 3A. Toner is directed from the supply tube 71 to the nip between the aluminum donor roll 70 and the foam roller 36. Excess fluid is removed from the foam roller 36 by a scraper blade 72 and flows down return line 73. The foam roller 36 then contacts the glass segment 30 which travels opposite to the direction of the foam roller 36 at the point of contact.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. In a xerographic system image development station which uses a liquid toner to develop latent xerographic images on a xeroradiographic plate, a toner density controller for measuring the toner density in said image development station comprising:

a glass plate having one electrically conductive surface, charged to an electrical potential, a controller development station comprising a controller fountain having a slot from which flows said liquid toner and means for passing said glass plate over, and in contact with, said toner flowing from said controller fountain slot, for applying toner to said conductive surface, means for optically measuring the density of the applied toner, a cleaning station for cleaning the toner from said conductive surface, and means for transporting said plate from said development station to said means for measuring and said cleaning station, in that order.

2. The controller of claim 1 wherein said controller development station further comprises an electrode for holding the toner at an electrical potential with respect to the plate, and a wiper, driven by said means for transporting to clear the slot after each development cycle.

3. The controller of claim 1 wherein said controller development station further comprises an electrode for maintaining said toner at an electrical bias with respect to said glass plate, thus creating a development field which is similar in intensity to the field which the xeroradiographic plate carrying the latent image encounters when being developed by the image development station.

* * * * *